US008062719B2

(12) United States Patent
Poncelet et al.

(10) Patent No.: US 8,062,719 B2
(45) Date of Patent: Nov. 22, 2011

(54) MATERIAL INTENDED FOR FORMING OR PRINTING IMAGES AND ITS MANUFACTURING METHOD

(75) Inventors: Olivier J. Poncelet, Grenoble (FR); Gérard A. Friour, Chalon-sur-Saône (FR); Ilias Iliopoulos, Paris (FR)

(73) Assignee: Eastman Kodak Company, Rochester, NY (US)

( * ) Notice: Subject to any disclaimer, the term of this patent is extended or adjusted under 35 U.S.C. 154(b) by 389 days.

(21) Appl. No.: 12/304,783

(22) PCT Filed: Jun. 13, 2007

(86) PCT No.: PCT/EP2007/005219

§ 371 (c)(1), (2), (4) Date: Dec. 15, 2008

(87) PCT Pub. No.: WO2008/000352

PCT Pub. Date: Jan. 3, 2008

(65) Prior Publication Data

US 2009/0208679 A1 Aug. 20, 2009

(30) Foreign Application Priority Data

Jun. 29, 2006 (FR) ..... 06 05826

(51) Int. Cl.
*B41M 5/00* (2006.01)

(52) U.S. Cl. ..... 428/32.23; 428/32.24; 428/32.25; 428/32.26; 428/32.28; 428/32.34; 428/32.38; 427/243

(58) Field of Classification Search ..... 428/32.23, 428/32.24, 32.25, 32.26, 32.28, 32.34, 32.38; 427/243

See application file for complete search history.

(56) References Cited

U.S. PATENT DOCUMENTS

| | | | | |
|---|---|---|---|---|
| 6,645,624 | B2 * | 11/2003 | Adefris et al. | 428/402 |
| 2002/0061288 | A1 * | 5/2002 | Hubbell et al. | 424/78.17 |

FOREIGN PATENT DOCUMENTS

| | | |
|---|---|---|
| EP | 1 419 893 | 5/2004 |
| EP | 1 510 354 | 3/2005 |
| FR | 2 031 396 | 11/1970 |
| FR | 2 836 564 | 8/2003 |

* cited by examiner

*Primary Examiner* — Betelhem Shewareged
(74) *Attorney, Agent, or Firm* — Arthur E. Kluegel; Andrew J. Anderson

(57) ABSTRACT

The present invention relates to a material intended for forming or printing images, comprising a support and at least one hydrophilic binder-based layer, and its manufacturing method, said method enabling the gelation process of the hydrophilic binder to be controlled. The material according to the invention is characterized in that in at least one of said hydrophilic binder-based layers, said hydrophilic binder is gelated by complexation with a complexing agent present on a heat-sensitive polymer or copolymer, that is hydrophobic at temperatures higher than its lower critical solution temperature LCST to protect the complexing agent, and water-soluble at temperatures less than its LCST to make the complexing agent accessible, the LCST of the heat-sensitive (co)polymer being higher than the setting temperature of said hydrophilic binder. The material according to the invention can be used as photographic material or as material taking aqueous ink compositions applied by the inkjet printing technique.

22 Claims, No Drawings

MATERIAL INTENDED FOR FORMING OR PRINTING IMAGES AND ITS MANUFACTURING METHOD

FIELD OF THE INVENTION

The present invention relates to a material intended for forming or printing images, comprising a support and at least one hydrophilic binder-based layer, and a manufacturing method of said material. Said material can be, for example, a material intended to receive water-based ink compositions by the inkjet printing technique or a photographic material.

BACKGROUND OF THE INVENTION

Conventionally, materials intended to receive water-based inks by the inkjet printing technique are obtained by coating different layers on a support. The absorber layer absorbs the liquid part of the water-based ink composition after imaging. Elimination of the liquid reduces the risk of ink migration to the surface. The ink fixing layer prevents any ink loss into the fibers of the paper base to obtain good color saturation while preventing excess ink that would promote the increase in size of the printing dots and reduce the image quality. The absorber layer and fixing layer can also constitute a single layer ensuring both functions. The protective layer is designed to ensure protection against fingerprints and the pressure marks of the printer feed rollers. Some of these layers have a hydrophilic binder base, such as poly(vinyl alcohol).

Coating technology is also used in the photographic field, where photographic materials are obtained by coating various hydrophilic binder-based layers onto a support, especially image-forming silver halide emulsion layers, but also protection layers, intermediate layers such as an antihalation layer, an antistatic layer, etc. Such arrangements are described in *Research Disclosure*, Item 38957, page 624, section XI (September 1996). *Research Disclosure* is a publication of K enneth Mason Publications Ltd., Dudley House, 12 North Street, Emsworth, Hampshire PO10 7DQ, United Kingdom.

The hydrophilic binder generally used in the photographic field is gelatin, known for its rapid setting properties after coating, which enables high-speed coating processes. Poly (vinyl alcohol) has the disadvantage of setting less rapidly than gelatin. Its use thus entails a reduction of the coating speed that does not enable either cost reductions or productivity increases.

There have been attempts to improve the setting properties of poly(vinyl alcohol), especially in order to be able to replace gelatin by poly(vinyl alcohol) or in order to be able to use conventional photographic material coating installations to produce materials for inkjet printing.

One solution to improve the setting properties of poly (vinyl alcohol) consisted in using hardeners. Thus, DHD (dihydroxydioxane) has been used as hardener to improve the physical properties of coating. However, not only can DHD present toxicity problems, but it is also not a rapid hardener. The results are thus not a good as predicted. Sodium tetraborate (borax) has also been used as a hardener. Such a compound, thanks to its borate anions, reacts as a dicomplexation reaction with the hydroxy groups of the hydrophilic binder, leading to the gelation of the hydrophilic binder via intra and interchained didiol complexes. As the dicomplexation reaction is very rapid, borax enables a coating with excellent setting properties to be obtained. However, as borax is very efficient, it is difficult to mix it with the hydrophilic binder before coating. Indeed, borax starts to react with the binder prior to coating, and strongly modifies the binder's viscosity, which causes it to gel before the coating of the required surface, resulting in a material having poor physical properties, the appearance of coating defects, or even the stopping of the coating by the blocking of the coating machine if the binder's viscosity becomes too high.

Therefore, there is a need for a new material intended for forming or printing images, comprising a hydrophilic binder-based layer, and its new manufacturing method, enabling the gelation process of said hydrophilic binder, such as poly (vinyl alcohol), to be optimized and better controlled in order to obtain a hydrophilic binder-based layer that is uniform and has good physical properties.

SUMMARY OF THE INVENTION

For this purpose, the new material according to the invention intended for forming and printing images, comprises a support and at least one hydrophilic binder-based layer, and is characterized in that, in at least one of said hydrophilic binder-based layers, said hydrophilic binder is gelated by complexation with a complexing agent present on a heat-sensitive polymer or copolymer, that is hydrophobic at temperatures higher than its lower critical solution temperature LCST to protect the complexing agent, and water-soluble at temperatures less than its LCST to make the complexing agent accessible, the LCST of the heat-sensitive (co)polymer being higher than the setting temperature of said hydrophilic binder.

The present invention also relates to a manufacturing method of a material intended for the formation or printing of images, comprising a support and at least one hydrophilic binder-based layer, said method comprising the following steps:

(i) prepare a heat-sensitive polymer or copolymer comprising a complexing agent of said hydrophilic binder, said heat-sensitive polymer or copolymer being hydrophobic at temperatures higher than its lower critical solution temperature LCST to protect the complexing agent, and water-soluble at temperatures lower than its LCST to make the complexing agent accessible, (ii) mix said heat-sensitive (co)polymer with the hydrophilic binder at a temperature higher than the LCST, (iii) coat said support with at least one layer of the mixture obtained according to step (ii) at a temperature higher than the LCST, and (iv) submit the layer obtained in step (iii) to a temperature less than the LCST, in order to make the complexing agent accessible to gel said hydrophilic binder by complexation.

DETAILED DESCRIPTION OF THE INVENTION

According to one embodiment, the complexing agent is grafted onto a heat-sensitive copolymer containing essentially a monomer of general formula CH2=CRC=ONR1R2 where R can be H or CH3 and R1, R2 may be the same or different and represent an alkyl group (straight or branched chain) or an aryl group (substituted or unsubstituted), copolymerized with a monomer comprising grafting units capable of reacting with the complexing agent to graft it onto the copolymer.

According to one embodiment, the complexing agent comprises boronate units capable of complexing the hydrophilic binder.

Preferably, the material according to the present invention comprises a layer based on poly(vinyl alcohol) complexed by 3-aminophenylboronic acid grafted onto acid units belonging to a heat-sensitive copolymer containing essentially N-isopropylacrylamide copolymerized with an acrylic acid monomer as monomer. Another way of obtaining the material of the present invention would be the copolymerization of N-alkylacrylamide with a monomer bearing a phenylboronic group.

The method according to the present invention enables the gelation process of the hydrophilic binder to be controlled by acting on the temperature in relation to the LCST of the (co)polymer comprising the complexing agent.

Other characteristics will appear on reading the following description.

The material according to the present invention comprises firstly a support. This support is chosen according to the desired use. It may be a transparent or opaque thermoplastic film, in particular a polyester base film such as polyethylene terephthalate; cellulose derivatives, such as cellulose ester, cellulose triacetate, cellulose diacetate; polyacrylates; polyimides; polyamides; polycarbonates; polystyrenes; polyolefines; polysulfones; polyetherimides; vinyl polymers such as polyvinyl chloride; and mixtures thereof. The support used in the invention may also be paper, both sides of which may be coated with a polyethylene layer. When the support comprising paper pulp is coated on both sides with polyethylene, it is referred as Resin Coated Paper (RC Paper) and is commercially available under various brand names. This type of support is especially preferred to prepare a material intended for inkjet printing. The side of the support that is used can be coated with a very thin layer of gelatin or another composition to ensure the adhesion of the first layer to the support. To improve the adhesion of the hydrophilic binder-based layer to the support, the support surface can also have been subjected to a preliminary treatment by Corona discharge before coating the hydrophilic binder-based layer.

The material according to the invention then comprises at least one hydrophilic binder-based layer. A hydrophilic binder means a compound having hydroxy groups, preferably vicinal in position cis 1,2 or 1,3, capable of forming complexes with the complexing agent leading to the chemical gelation of the system. Such a hydrophilic binder may be poly(vinyl alcohol) or hydroxypropylcellulose. Poly(vinyl alcohol) is for example commercially available from Nippon Gohsei.

According to the present invention, in at least one hydrophilic binder-based layer, said hydrophilic binder is gelated by complexation with a complexing agent present on a heat-sensitive polymer or copolymer, that is hydrophobic at temperatures higher than its lower critical solution temperature LCST to protect the complexing agent, and water-soluble at temperatures less than its LCST to make the complexing agent accessible, the LCST of the heat-sensitive (co)polymer being higher than the setting temperature of said hydrophilic binder. Setting temperature means the temperature at which the material has been subjected to cause the gelation of the hydrophilic binder.

A heat-sensitive (co)polymer has the advantage, in aqueous solution, of changing properties according to the temperature by undergoing a "pellet-globule" transition and by modifying its water solubility. Below the lower critical solution temperature called LCST, the heat-sensitive (co)polymer is deployed and totally soluble in water. Above its LCST, the heat-sensitive (co)polymer is not soluble and a phase separation is observed.

Preferably the heat-sensitive polymer is a copolymer containing as monomer essentially an N-alkylacrylamide whose has the general formula CH2=CRC=ONR1R2 where R can be H or CH3 and R1, R2 may be the same or different and represent an alkyl group (straight or branched) or an aryl group (substituted or unsubstituted), copolymerized with a monomer comprising grafting units capable of reacting with the complexing agent to graft it onto the copolymer.

Preferably, said alkyl group of heat-sensitive polymer of N-alkylacrylamide or N-alkylmethacrylamide is selected from among the group consisting of methyl, ethyl, n-propyl, isopropyl, and n-butyl groups.

Preferably, the heat-sensitive polymer is poly(N-isopropylacrylamide).

Preferably, the monomer comprising grafting units capable of reacting with the complexing agent and copolymerized with the heat-sensitive polymer is acrylic acid or methacrylic acid, giving acid functionality grafting units.

Other monomers may be used to form terpolymers or more.

The nature and proportions of the various monomers used to prepare the heat-sensitive copolymer are selected according to the number of grafting units required for the grafting of the complexing agent and the value of the LCST sought. In this way, the nature of the monomers incorporated in the heat-sensitive polymers has an influence on the LCST: the incorporation of hydrophilic monomers causes an increase of the LCST; conversely, the introduction of hydrophobic monomers causes a reduction of the LCST.

Preferably, the heat-sensitive copolymer is prepared from 90-95% of the heat-sensitive polymer copolymerized with 5-10% of the monomer comprising grafting units capable of reacting with the complexing agent for grafting it on the copolymer.

Preferably, the heat-sensitive copolymer comprises 90% poly(N-isopropylacrylamide) and 10% acrylic acid.

The polymers and copolymers useful in the invention preferably have molecular weight between 10,000 and 200,000, and preferably about 30,000.

According to the present invention, a complexing agent of the hydrophilic binder is incorporated with the heat-sensitive (co)polymer. Preferably, the complexing agent comprises boronate units capable of complexing the hydrophilic binder, and more particularly the hydroxy functions of the hydrophilic binder to lead to the chemical gelation of the system.

Preferably, the complexing agent has the formula $RB(OH)_2$ where R is a phenyl group substituted with a radical capable of grafting onto the grafting units. For this purpose, said radical has a function reacting with the grafting units present on the heat-sensitive (co)polymer, such that the complexing agent grafts onto said heat-sensitive (co)polymer.

Preferably, R is 3-aminophenyl group and the complexing agent is 3-aminophenylboronic acid.

The material according to the invention is prepared according to a process comprising the following steps:

(i) prepare a heat-sensitive polymer or copolymer comprising a complexing agent of said hydrophilic binder, said heat-sensitive polymer or copolymer being hydrophobic at temperatures higher than its lower critical solution temperature LCST to protect the complexing agent, and water-soluble at temperatures lower than its LCST to make the complexing agent accessible, (ii) mix said heat-sensitive (co)polymer with the hydrophilic binder at a temperature higher than the LCST, (iii) coat the support with at least one layer of the mixture obtained according to step (ii) at a temperature higher than the LCST, and (iv) submit the layer obtained in step (iii) to a temperature less than the LCST, in order to make the complexing agent accessible to gel said hydrophilic binder by complexation.

The heat-sensitive copolymer is prepared according to polymerization techniques known to those skilled in the art. N-isopropylacrylamide and acrylic acid monomer can be copolymerized by free radical copolymerization using a redox initiator.

The grafting of the complexing agent is carried out according to conventional techniques known to those skilled in the art, especially using a coupling agent, such as a water-soluble carbodiimide, e.g. 1-(3-dimethylaminopropyl)-3-ethyl-carbodiimide hydrochloride (EDC).

Coating on the support uses conventional coating methods, such as blade coating, knife coating or curtain coating. The coated thicknesses are those conventionally used in photographic applications or for inkjet printing.

According to the invention method, the mixture of hydrophilic binder/heat-sensitive (co)polymer bearing the complexing agent is maintained at a temperature higher than the LCST of the heat-sensitive (co)polymer bearing the complexing agent of the hydrophilic binder, so long as this mixture has not been coated on the support to form the hydrophilic binder-based layer. Thus, the heat-sensitive (co)polymer remains hydrophobic and in a contracted form in which the complexing agent is "hidden" and protected, such that the hydrophilic binder is not complexed and not gelated. Thus, the mixture is entirely liquid and can easily coat the whole surface of the support, with no risk of blocking the coating machine.

Once the hydrophilic binder-based layer has been coated, it is subjected to a temperature less than the LCST of the heat-sensitive (co)polymer, for example when the support moves into the setting area of the coating machine where the temperature drops sharply, such that the heat-sensitive (co)polymer becomes water-soluble. Thus, the heat-sensitive chains swell and expose the complexing agent, making it accessible to the hydroxy functions of the hydrophilic binder. The gelation and hardening of the hydrophilic binder then occur rapidly by the didiol complexations. A chain of heat-sensitive copolymer, having several groups of complexing agent, will be capable of interacting with different chains of hydrophilic binder, leading to the gelation of the system. The material according to the invention therefore comprises a layer in which the hydrophilic binder, gelated by complexation with the complexing agent, sets rapidly and irreversibly to provide a uniform layer that has good physical properties. The heat-sensitive copolymer protects the complexing agent and only initiates the gelation and setting process of the hydrophilic binder once the hydrophilic binder-based layer has been coated. The gelation and setting process of the hydrophilic binder is thus completely controlled by acting on the temperature.

The material can then be dried in a drier through which the supports pass vertically (loop drier), which accelerates the drying speed and productivity as well.

Preferably, in the final layer, the hydrophilic binder will represent between 2% and 15% based on dry weight and the heat-sensitive (co)polymer comprising the complexing agent of the hydrophilic binder will represent between 1% and 10% based on dry weight.

The material according to the invention can be used in the photographic field, said hydrophilic binder-based layer constituting an image-forming silver halide emulsion layer. In this case, the hydrophilic binder can be prepared, in addition to the special aspects of the method according to the invention, according to conventional operations as described in Research Disclosure, Item No 36544, September 1994, page 501, chapter I, II, III to prepare appropriate emulsions. The emulsions can contain conventional additives used, as mentioned in the above-mentioned Research Disclosure, chapter VI, VII, VIII. The emulsions can also contain other additives, such as agents modifying the mechanical or physical properties of the layers, as described in the above-mentioned Research Disclosure, chapter IX. Nevertheless, the additives must be compatible with the heat-sensitive (co)polymer comprising the complexing agent of the hydrophilic binder.

When the material according to the invention is intended for applications involving inkjet printing, said hydrophilic binder-based layer is an ink-receiving layer intended to receive an aqueous ink composition applied by the inkjet printing technique. In this case, the gelated hydrophilic binder can be used with additives conventionally used in inkjet applications, but which must be compatible with the heat-sensitive (co)polymer comprising the complexing agent of the hydrophilic binder. For example, the hydrophilic binder-based layer can contain between 5% and 95% by weight of fillers based on the total weight of the dry layer. Such fillers can be inorganic fillers such as colloidal or pyrogenated silicas, or organic fillers such as polyacrylic or polymethacrylic type latex. The material intended for forming images by inkjet printing according to the invention can comprise, in addition to the ink-receiving layer described above, other layers having other functions, arranged above or below said ink-receiving layer. The ink-receiving layer as well as the other layers can comprise any other additives known to those skilled in the art to improve the properties of the resulting image, such as UV absorbers, optical brighteners, antioxidants, plasticizers, etc.

The following examples illustrate, but not limit, the present invention.

1) Preparation of a Heat-Sensitive Copolymer

A copolymer of N-isopropylacrylamide and acrylic acid, molecular weight of about 30,000 g/mol, having 10% acrylic acid units was prepared.

The following products were used:

N-isopropylacrylamide: M=113.16 g/mol, CAS No. 2210-25-5, commercially available from Acros Organics Acrylic acid: M=72.06 g/mol, CAS No. 79-70-7, commercially available from Acros Organics 20.4 g of N-isopropylacrylamide and 1.442 g of acrylic acid in about 180 ml osmosed water were introduced into a reactor, under an argon atmosphere. The reactor was maintained at 25° C., under argon atmosphere for 30 minutes. Then 18 ml of 1M soda were added to neutralize the acrylic acid 90%. A final pH of the reaction mixture of about 5.5/6 was obtained. 2.338 g of NaCl salt were added and the reactor was maintained at 25° C., under argon atmosphere for one hour. The redox initiators of the polymerization, i.e. 0.0576 g of ammonium persulfate $(NH4)_2S_2O_8$ and 0.38 g of sodium metabisulfite $Na_2S_2O_5$, were dissolved separately in 10 ml of water. The resulting solutions were added into the reactor. The resulting mixture was stirred for 12 hours at 25° C., then dialyzed for one week using a cellulose dialysis membrane with cut-off of 10,000-20,000 Dalton. Then, the solution containing the copolymer was lyophilized. 20 g of poly(NIPAM-co-acrylic acid) were obtained comprising 10% units of acrylic acid, hereafter referred to as PNIPAM-co-AA). This copolymer has an LCST of 48.4° C. in 1% solution in water and an LCST of 42.6° C. in 5% solution in water.

In the resulting copolymer, the acrylic acid units were essentially found as sodium salt.

2) Grafting the Heat-Sensitive Copolymer by the Complexing Agent of the Hydrophilic Binder As complexing agent, 3-aminophenylboronic acid was selected, capable of complexing the hydroxy functions of the poly(vinyl alcohol). This complexing agent was grafted onto the acid functions of the acrylic acid units of the heat-sensitive copolymer obtained in section 1.

Coupling agent 1-(3-dimethylaminopropyl)-3-ethyl-carbodiimide hydrochloride (hereafter referred to as EDC) was used, which reacts with the copolymer acid functions and the amine function of the complexing agent to form amide linkages.

83 ml osmosed water were introduced into a reactor under argon atmosphere and at ambient temperature (25° C.), then 10 g of the copolymer P(NIPAM-co-AA) obtained in section 1 were added gradually. Complete dissolution was waited for. Separately, 1.676 g of 3-aminophenylboronic acid as hemisulfate were dissolved in 33 ml osmosed water, then this solution was introduced into the reactor. The mixture was stirred for 10 minutes, then 1.73 g of EDC previously dissolved in 3 ml of water were introduced into the reactor The resulting mixture was stirred for 12 hours at 25° C. under argon atmosphere. A white suspension was obtained. The suspension was added to 33 ml of ethanol in a beaker. The mixture was stirred and allowed to stand overnight. Phase separation occurred: a liquid phase at the bottom and a gel phase on top. The gel phase was separated in a beaker, in which 120 ml of water were added. The mixture was stirred for two hours at low temperature (below the LCST) in an ice bath, for the gel to be dissolved in the water. The resulting solution was lyophilized for three days. 9.90 g of poly (NIPAM-co-acrylic acid) copolymer were obtained grafted by boronate units, hereafter referred to as P(NIPAM-co-AA/B). This copolymer has an LCST of 26° C. in 1% solution in water and an LCST of 21.2° C. in 5% solution in water.

3) Preparation of a Material According to the Invention

The material according to the invention prepared according to the example below is particularly designed for applications for inkjet printing.

As inorganic fillers an amorphous silica polymer was prepared according to the following method:

3147 g tetraethyl orthosilicate was mixed with 400 g ethanol, 1680 g deionized water and 40 ml of hydrochloric acid solution 0.1M. It was stirred for 10 minutes at ambient temperature then for 1.5 hours at 50° C. The mixture was then incubated without stirring for eight hours at 60° C. The resulting gel was then lyophilized to a constant weight. The resulting powder was ground. 1023.9 g of white powder was obtained.

Poly(vinyl alcohol) (PVA) Gohsenol GH23 commercially available from Nippon Goshei in 9% solution was used as hydrophilic binder.

The heat-sensitive copolymer P(NIPAM-co-AA/B) prepared in section 2 was made into 2% solution in water.

The composition of the layer was the following:

Silica polymer=2.85 g

PVA=4 g

P(NIPAM-co-AA/B)=12.37 g

Water for =33 g

On one hand the silica polymer was mixed with the PVA and water, then the mixture was heated to 40° C. On the other hand, the 2% solution of P(NIPAM-co-AA/B) was heated to 40° C. Then all was mixed at 40° C. for two minutes before coating. This temperature was above the LCST of the heat-sensitive copolymer in order to protect the complexing agent and prevent the reaction with the PVA.

A Resin Coated Paper type support was placed on a coating machine, first coated with a very thin gelatin layer and held on the coating machine by vacuum. This support was coated with a composition as prepared above using a blade heated with hot air just before coating. The coating wet thickness was 300 μm. Then, it was left to dry for 24 hours at ambient temperature (21° C.). Then the temperature went above the LCST of the heat-sensitive copolymer such that the boronate complexing agent was accessible and reacted with the PVA to gelate and set the layer.

4) Study of the Setting Properties

The material support was attached by suction using a vacuum extractor to a bench thermostated at 18° C. A coating blade was moved on the bench at a controlled speed using a motor. After the blade, it is possible to move a series of three air jets at different pressures, to induce a disturbance on the wet layer during its setting. The trace left by the air jet could be observed on the coating.

For this purpose, a layer having the composition described in section 3 and a thickness of 50 μm was coated on the support. For comparison, a comparative material was prepared by coating a support with a layer of similar composition (3 g of silica polymer, 4 g of PVA for 22 g of water) but not containing grafted heat-sensitive copolymer. The compositions were previously heated to 40° C.

The applied air jets had a pressure of 10, 50 and 90 mbar and the disturbance was applied 25 seconds after coating.

For the air jet with pressure 10 mbar, no trace was observed for any material.

For the air jet with pressure 50 mbar, a trace left by the air jet on the layer of the comparative material was observed. The layer of the material of the invention showed no trace.

For the air jet with pressure 95 mbar, the layer of the material according to the invention showed a trace much slighter than that of the comparative material, for which no grafted heat-sensitive polymer was used.

These results show that the material according to the invention is much less sensitive to the air jets than the comparative material. The setting of the layer was thus better with the material according to the invention than with the comparative material.

5) Evaluating Colorfastness Over Time

To evaluate colorfastness over time, a color alteration test by exposure to ozone was performed for the material of the invention and the comparative material. Test charts, comprising four colors (black, yellow, cyan and magenta) were printed on the resulting materials using a Hewlett-Packard HP 5550 printer and the related ink. The test charts were analyzed using a GretagMacbeth Spectrolino densitometer that measures the strength of the various colors. Then the materials were placed in the dark in a room with controlled ozone atmosphere (1 ppm) for 24 hours. Any deterioration of color density is monitored using the densitometer.

A color alteration test was also carried out by exposure to light of 50 Klux for two weeks. Test charts, comprising four colors (black, yellow, cyan and magenta) were printed on the resulting materials using a Hewlett-Packard HP 5550 printer and the related ink. Then, the printed test charts were placed under a sheet of Plexiglas® 6 mm thick and totally transparent to the emission spectra of the neon tubes used (Osram Lumilux® FQ 80 W/840 Cool White), in order to minimize atmospheric oxidation phenomena. Any deterioration of the color density was measured using the densitometer after two weeks.

No loss of density was observed, whether for the material of the invention or comparative, subject to the ozone or the light. The material according to the invention had very high stability to ozone and light, substantially the same as the stability to ozone and light of the comparative material. This demonstrated that the use of the heat-sensitive copolymer grafted by a complexing agent of the PVA did not alter the properties of stability to light and ozone of the material.

6) Evaluation of the Physical Properties a) Scratching Test:

Equipment was used comprising a rotating support onto which was placed the material to be analyzed, and an arm fitted with a metal tip applied to the material, to which weights could be added to increase the force of the scratching.

Printed onto the material according to the invention and the comparative material was the color magenta at Dmax by using a Hewlett Packard HP 5550 printer and the related ink. The printed materials were then subjected to the scratching test. The minimum weight required to scratch the material was determined: for the material according to the invention, a weight of 7 grams was required to observe a scratch while a weight of 3 grams was sufficient to scratch the comparative material.

These results demonstrated that the material according to the invention comprising a layer gelated by a complexing agent grafted onto a heat-sensitive copolymer was more resistant to scratching than the comparative material and said grafted copolymer had enabled the layer to be hardened by reaction with the PVA.

b) Pull-Off Test

This test was used to assess the liability of the slayer coated on the support to be damaged by pulling-off, and thus the hardness of the layer.

Equipment was used comprising a flail moving around an axis, one of the arms having a diamond tip at its end, the other a balancing counterweight. A balancing device that can receive additional loads slides on the diamond-holder arm.

The test consisted in moving a diamond tip subject to an increasing load on the surface of the material.

Printed onto the material according to the invention and the comparative material was the color magenta at Dmax by using a Hewlett Packard HP 5550 printer and the related ink. The printed materials were then subjected to the pull-off test. Weights between 50 g and 250 g were used for this test. For each of these weights, the surface of the comparative material was strongly deteriorated while the surface of the material according to the invention was not altered.

These results demonstrated that the material according to the invention comprising a layer gelated by a complexing agent grafted onto a heat-sensitive copolymer has a much harder surface than that of the comparative material.

The invention claimed is:

1. A material intended for forming or printing images, comprising a support and at least one hydrophilic binder-based layer, characterized in that, in at least one of said hydrophilic binder-based layers, said hydrophilic binder is gelated by complexation with a complexing agent present on a heat-sensitive polymer or copolymer, that is hydrophobic at temperatures higher than its lower critical solution temperature (LCST) to protect the complexing agent, and water-soluble at temperatures less than its LCST to make the complexing agent accessible, the LCST of the heat-sensitive (co) polymer being higher than the gelation temperature of said hydrophilic binder.

2. The material according to claim 1, characterized in that the complexing agent is grafted onto a heat-sensitive copolymer containing as monomer essentially an N-alkylacrylamide of general formula CH2=CRC=ONR1R2 where R can be H or CH3 and R1, R2 can be the same or different and represent an alkyl group (straight or branched) or an aryl group (substituted or unsubstituted), copolymerized with a monomer comprising grafting units capable of reacting with the complexing agent to graft it onto the copolymer.

3. The material according to claim 2, characterized in that said alkyl group of heat-sensitive (co)polymer of N-alkylacrylamide or N-alkylmethacrylamide is selected from among the group comprising methyl, ethyl, n-propyl, isopropyl, and n-butyl groups.

4. The material according to claim 2, characterized in that monomer comprising the grafting units is selected from acrylic acid and methacrylic acid.

5. The material according to claim 1, characterized in that the complexing agent comprises boronate units capable of complexing the hydrophilic binder.

6. The material according to claim 2, characterized in that the complexing agent has the formula $RB(OH)_2$ where R is a phenyl group substituted with a radical capable of grafting onto the grafting units.

7. The material according to claim 6, characterized in that the complexing agent is 3-aminophenylboronic acid.

8. The material according to claim 1, wherein the hydrophilic binder is selected from poly(vinyl alcohol) or hydroxypropylcellulose.

9. The material according to claim 1, wherein at least one of said hydrophilic binder-based layers is a layer receiving aqueous ink compositions coated by an inkjet printing technique.

10. The material according to claim 9, wherein said hydrophilic binder-based layer contains between 5% and 95% by weight of fillers based on the total weight of the dry layer.

11. The material according to claim 1, wherein at least one of said hydrophilic binder-based layers is an image-forming silver halide emulsion layer.

12. A manufacturing method of a material intended for forming or printing images and comprising a support and at least one hydrophilic binder-based layer, said method comprising the following steps:

(i) preparing a heat-sensitive polymer or copolymer comprising a complexing agent of said hydrophilic binder, said heat-sensitive polymer or copolymer being hydrophobic at temperatures higher than its lower critical solution temperature (LCST) to protect the complexing agent, and water-soluble at temperatures lower than its LCST to make the complexing agent accessible;

(ii) mixing said heat-sensitive (co)polymer with the hydrophilic binder at a temperature higher than the LCST;

(iii) coating said support with at least one layer of the mixture obtained according to step (ii) at a temperature higher than the LCST; and (iv) submitting the layer obtained in step (iii) to a temperature less than the LCST, in order to make the complexing agent accessible to gel said hydrophilic binder by complexation.

13. The method according to claim 12, wherein the hydrophilic binder is selected from poly(vinyl alcohol) or hydroxypropylcellulose.

14. The method according to claim 12, wherein step (i) comprises the grafting of the complexing agent onto a heat-sensitive copolymer obtained from a heat-sensitive polymer of N-alkylacrylamide whose monomer has the general formula CH2=CRC=ONR1R2 where R can be H or CH3 and R1, R2 can be the same or different and represent an alkyl group (straight or branched) or an aryl group (substituted or unsubstituted), copolymerized with a monomer comprising grafting units capable of reacting with the complexing agent to graft it onto the copolymer.

15. The method according to claim 14, wherein the heat-sensitive copolymer is obtained from 90-95% of the heat-sensitive polymer and 5-10% of the monomer comprising grafting units capable of reacting with the complexing agent.

16. The method according to claim 14, wherein said alkyl group of heat-sensitive polymer of N-alkylacrylamide or N-alkylmethacrylamide is selected from among the group consisting of methyl, ethyl, n-propyl, isopropyl, and n-butyl groups.

17. The method according to claim 14, wherein the monomer comprising the grafting units is selected from acrylic acid and methacrylic acid.

18. The method according to claim 12, wherein the heat-sensitive (co)polymer comprising a complexing agent of said hydrophilic binder has a molecular weight between 10,000 and 200,000 Da.

19. The method according to claim 12, wherein the complexing agent comprises boronate units capable of complexing the hydrophilic binder.

20. The method according to claim 19, characterized in that the complexing agent has the formula $RB(OH)_2$ where R is a phenyl group substituted with a radical capable of grafting onto the grafting units.

21. The method according to claim 20, wherein the complexing agent is 3-aminophenylboronic acid.

22. The method according to claim 12, according to which in the gelled layer, the hydrophilic binder will represent between 2% and 15% based on dry weight and the heat-sensitive (co)polymer comprising the complexing agent of the hydrophilic binder will represent between 1% and 10% based on dry weight.

* * * * *